United States Patent [19]

Brantingham et al.

[11] Patent Number: 4,744,613

[45] Date of Patent: May 17, 1988

[54] COMBINATION TOOL BOX AND STOOL

[75] Inventors: Mark Brantingham, Lisbon; Robert Coffee, Salem, both of Ohio

[73] Assignee: Brantingham Design Inc., Lisbon, Ohio

[21] Appl. No.: 41,976

[22] Filed: Apr. 24, 1987

[51] Int. Cl.[4] ..... A47B 83/00

[52] U.S. Cl. ..... 312/235 R; 312/237; 312/244; 312/284; 206/216; 206/349

[58] Field of Search ..... 206/349, 373, 216, 315, 206/11; 312/DIG. 33, 284, 244, 233 R, 237

[56] References Cited

U.S. PATENT DOCUMENTS

| | | | |
|---|---|---|---|
| 1,268,124 | 6/1918 | Jennings | 312/244 X |
| 3,305,076 | 2/1967 | Fleenor | 312/244 |
| 3,481,066 | 12/1969 | Woolworth | 312/244 X |
| 4,387,940 | 6/1983 | Chandler | 206/349 X |
| 4,460,085 | 7/1984 | Jantzen | 312/DIG. 33 X |
| 4,505,386 | 3/1985 | Abrahamson | 206/315.11 |
| 4,550,828 | 11/1985 | Baldwin et al. | 312/DIG. 33 |

*Primary Examiner*—Joseph Falk

*Attorney, Agent, or Firm*—Harpman & Harpman

[57] ABSTRACT

A combination tool box and stool that provides a self-contained multiple compartmentalized tool box configuration within an independent structural support case defining a stool independent of the tool box.

3 Claims, 2 Drawing Sheets

COMBINATION TOOL BOX AND STOOL

BACKGROUND OF THE INVENTION

1. Technical Field

This invention relates to storage devices that are used to organize and contain tools or the like in multiple compartments within a single enclosure.

2. Description of Prior Art

Prior Art devices of this type have relied on a variety of different enclosure designs, usually having an outer case configuration with a hingeable lid with a handle secured thereon. Secondary trays or compartmental dividers are arranged within the enclosure and in some tool box designs a plurality of drawers are used to provide different storage areas.

SUMMARY OF THE INVENTION

A self-contained combination tool box and stool for use in storing and carrying a variety of tools or the like has a multi-part inner-dependent storage compartments and a removable outer case that is an independent self-contained stool when removed from the tool box.

DESCRIPTION OF THE PREFERRED EMBODIMENT

Figure 1:
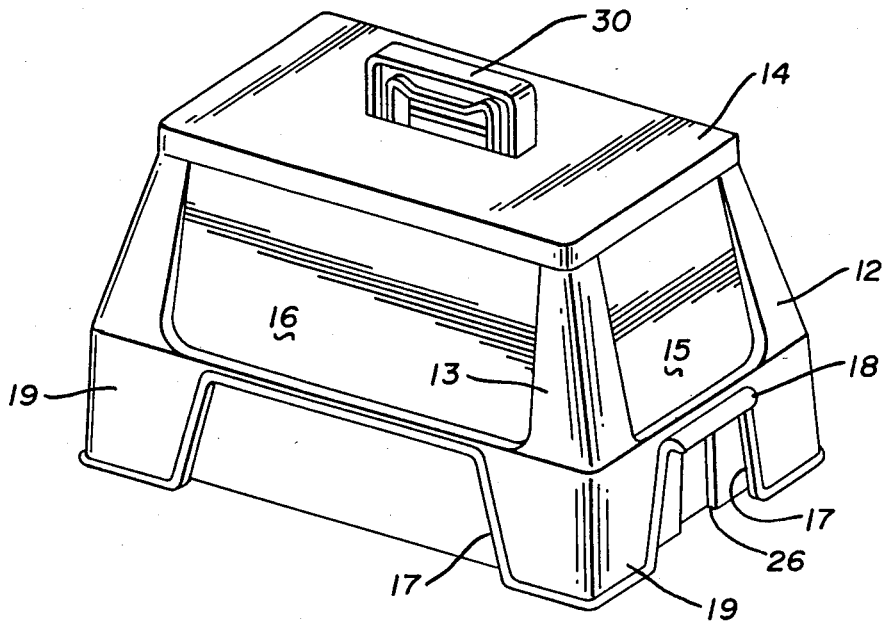
FIG. 1 is a perspective view of the combination tool box and stool.
Figure 4:
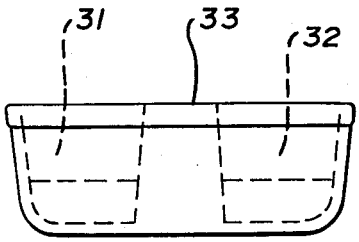
FIG. 4 is an end plan view of a removable tray portion of the tool box and stool.
Figure 5:
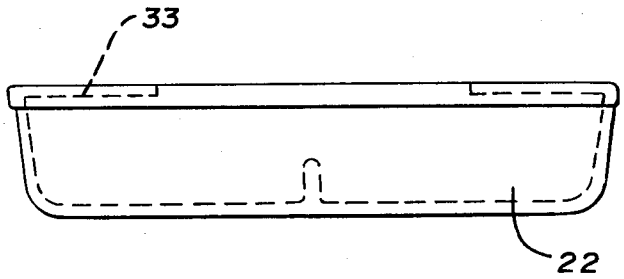
FIG. 5 is a side plan view of the tray portion shown in FIG. 4.
Figure 6:
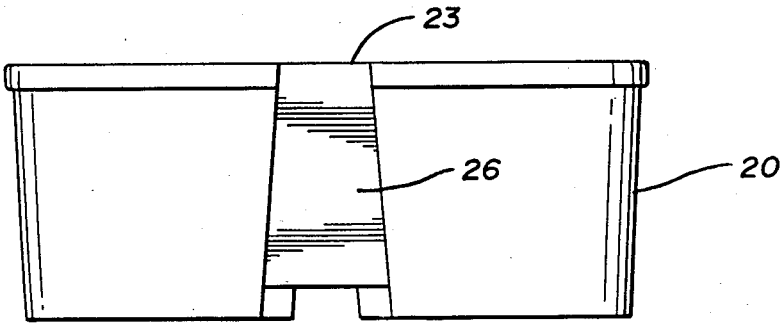
FIG. 6 is an end plan view of a base tray portion of the tool box and stool.
Figure 3:
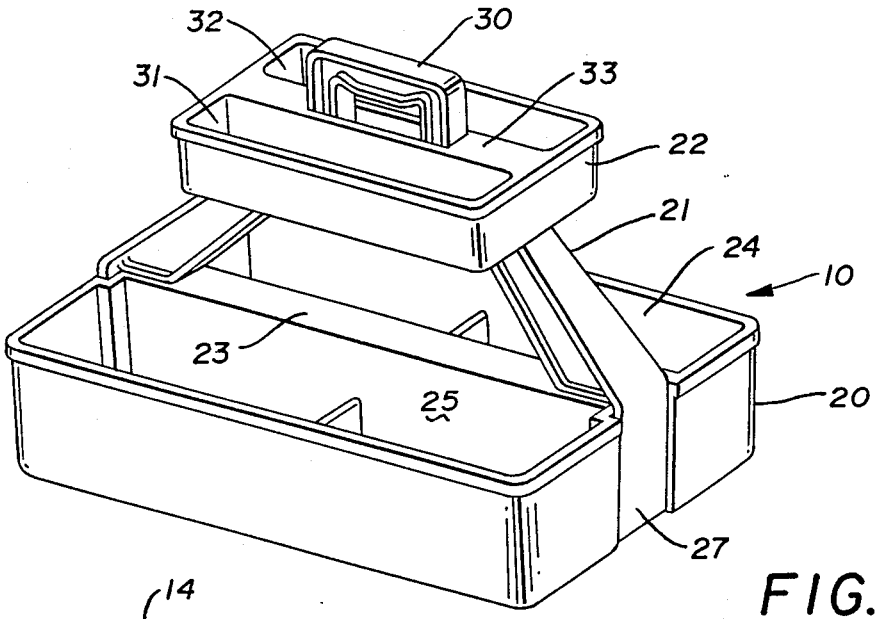
FIG. 3 is a perspective view of the tool box portion of the tool box and stool.
Figure 2:
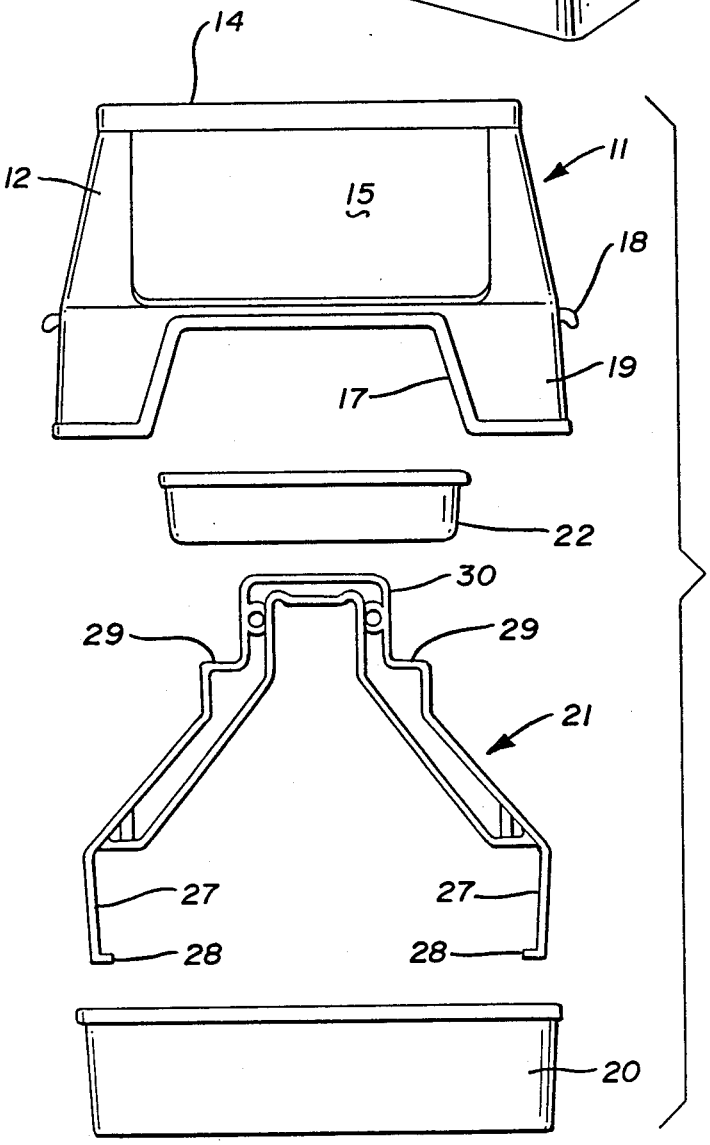
FIG. 2 is an exploded side plan view of the tool box and stool.

A combination tool box and stool can be seen in FIGS. 1, 2 and 3 of the drawings comprising a multi-part structure having a storage portion 10 and a stool portion 11. The stool portion 11 comprises a generally rectangular configuration having end walls 12, side walls 13 and a apertured top 14 intrical therewith. The upper portions of the walls and ends 12 and 13 are tapered inwardly and have recessed panels 15 and 16 within. Pairs of oppositely disposed cut outs 17 are formed on the lower portion and are aligned with the recessed panels 15 and 16 as here and before described. Handle lips 18 are formed adjacent the end cut outs best seen in FIG. 1 of the drawings. The cut outs 17 defines four support legs 19 for the stool portion 11.

Referring now to FIGS. 3, 4, 5 and 6 of the drawings, the storage portion 10 can be seen comprised of a storage base 20, a handle bracket 21 and a tool tray 22. The storage base 20 is generally rectangular with a rib divider 23 extending longitudinally there across defining two separate storage compartments 24 and 25 each of which is identical and has transversely extending partition within. A compound recess area 26 is formed on either end of said storage base 20 aligned with the rib divider 23. The handle bracket 21 comprises a reinforced inverted V-shaped configuration with vertically aligned spaced extensions 27 extending therefrom. Each of the extensions 27 have an inwardly facing flange 28 which is registerable along with the extensions 27 into the respective compound recessed area 26 as seen in FIG. 3 of the drawings. The V-shaped configuration of the handle bracket 21 has a pair of spaced oppositely disposed aligned shoulders 29 with an upstanding hand grip 30 extending therebetween. The tool tray 22 can be seen in FIGS. 2, 3, 4, and 5 of the drawings having two elongated bins 31 and 32 separated by an upstanding apertured rib 33.

In use after the handle bracket 21 is registerably secured to the storage base 20 the tool tray 22 is positioned down over the hand grip 30 through the apertured rib 33 onto the shoulders 29 of the handle bracket 21. The stool portion 11 is aligned and positioned down over the storage portion 10 with the hand grip 30 extending up through the aperture in the center of the top 14.

Once assembled the combination tool box and stool can be transported as a unit by the hand grip 30. By removing the stool portion 11 from the storage portion 10 the stool portion 11 can be used independently to support the user due to the reinforced nature of the stool configuration leaving the storage portion 10 accessible with its multiple compartmentalized storage base with intrical handle brackets and removable tool tray 22.

Thus, it can be seen that a new and useful combination tool box and stool has been illustrated and described and it will be apparent to those skilled in the art that various changes and modifications may be made therein without departing from the spirit of the invention. Therefore,

I claim:

1. A combination tool box and stool comprises in combination a storage portion having a storage base, compound recessed areas on said outer surface of said storage base, a reinforced handle support bracket extending from said compound recessed areas, a tool tray removably positioned on said reinforced handle support bracket in spaced relation to said storage base, a rib divider in said storage base defining horizontal and vertical stabilization for said storage base, a pair of oppositely disposed spaced shoulders on said handle support bracket for registerably securing said tool tray thereon, a stool portion removably secured on said handle support bracket, enclosing said tool tray and said storage base, said stool portion having reinforcing means registerable on said storage base, a hand grip on said handle support bracket registerably engaged through said tool tray and said stool portion.

2. A combination tool box and stool of claim 1 wherein said reinforcing means registerable on said storage base comprises support legs integral with said stool portion.

3. The combination tool box and stool of claim 1 wherein said stool portion has pairs of upper portion walls that are inwardly tapered equally.

* * * * *